US011713560B2

(12) United States Patent
Yamanaka et al.

(10) Patent No.: US 11,713,560 B2
(45) Date of Patent: Aug. 1, 2023

(54) HYDRAULIC EXCAVATOR AND SYSTEM

(71) Applicant: KOMATSU LTD., Tokyo (JP)

(72) Inventors: Nobuyoshi Yamanaka, Tokyo (JP); Toshiaki Kumagai, Tokyo (JP); Kensuke Fujii, Tokyo (JP)

(73) Assignee: KOMATSU LTD., Tokyo (JP)

( * ) Notice: Subject to any disclaimer, the term of this patent is extended or adjusted under 35 U.S.C. 154(b) by 395 days.

(21) Appl. No.: 16/978,853

(22) PCT Filed: Mar. 19, 2019

(86) PCT No.: PCT/JP2019/011556
§ 371 (c)(1),
(2) Date: Sep. 8, 2020

(87) PCT Pub. No.: WO2019/225133
PCT Pub. Date: Nov. 28, 2019

(65) Prior Publication Data

US 2020/0407952 A1 Dec. 31, 2020

(30) Foreign Application Priority Data

May 22, 2018 (JP) ..... 2018-098160

(51) Int. Cl.
*E02F 9/26* (2006.01)
*E02F 3/32* (2006.01)
*E02F 9/22* (2006.01)

(52) U.S. Cl.
CPC ..... *E02F 9/264* (2013.01); *E02F 3/32* (2013.01); *E02F 9/22* (2013.01)

(58) Field of Classification Search
CPC ..... E02F 3/32; E02F 3/435
See application file for complete search history.

(56) References Cited

U.S. PATENT DOCUMENTS

2015/0168136 A1 6/2015 Kamat et al.
2016/0117824 A1 4/2016 Amma et al.
2017/0002547 A1* 1/2017 Omote ..... E02F 9/264
2017/0342679 A1* 11/2017 Iwamura ..... E02F 9/262
2018/0058044 A1 3/2018 Deguchi et al.
2018/0087244 A1 3/2018 Deguchi et al.
2018/0266083 A1 9/2018 Narikawa et al.
(Continued)

FOREIGN PATENT DOCUMENTS

CN 103900497 A 7/2014
CN 106104197 A 11/2016
CN 107250725 A 10/2017
(Continued)

*Primary Examiner* — Abiy Teka
(74) *Attorney, Agent, or Firm* — Faegre Drinker Biddle & Reath LLP

(57) ABSTRACT

There is provided a hydraulic excavator allowing a simple configuration to be employed to determine a posture of a work implement accurately. The work implement and an imaging device are attached to a revolving unit. The work implement operates on a prescribed operating plane. The imaging device captures an image of the work implement at an angle larger than 0° with respect to the operating plane. The controller determines a position of the work implement relative to the revolving unit based on a posture of the work implement in the image captured by the imaging device.

11 Claims, 6 Drawing Sheets

(56) References Cited

U.S. PATENT DOCUMENTS

| | | | | |
|---|---|---|---|---|
| 2019/0292747 | A1* | 9/2019 | Takehara | E02F 3/432 |
| 2020/0218286 | A1 | 7/2020 | Tamasato | |

FOREIGN PATENT DOCUMENTS

| | | | |
|---|---|---|---|
| CN | 108007345 | A | 5/2018 |
| JP | 2009-121175 | A | 6/2009 |
| JP | 2009-287298 | A | 12/2009 |
| JP | 2015-056057 | A | 3/2015 |
| JP | 2015-224875 | A | 12/2015 |
| JP | 2016-003520 | A | 1/2016 |
| JP | 2017-071982 | A | 4/2017 |
| JP | 2017-181340 | A | 10/2017 |
| JP | 6263821 | B1 | 1/2018 |
| WO | WO-2017/056266 | A1 | 4/2017 |
| WO | WO-2017/056269 | A1 | 4/2017 |

* cited by examiner

HYDRAULIC EXCAVATOR AND SYSTEM

TECHNICAL FIELD

The present disclosure relates to a hydraulic excavator and a system.

BACKGROUND ART

For a hydraulic excavator, Japanese Patent Laying-Open No. 2017-71982 (PTL 1) discloses attaching a boom angle sensor to a boom pin, a dipper stick angle sensor to a dipper stick pin, and a bucket angle sensor to a bucket link to sense values which are in turn used to calculate the position of the tip of a tooth of the bucket.

CITATION LIST

Patent Literature

PTL 1: Japanese Patent Laying-Open No. 2017-71982

SUMMARY OF INVENTION

Technical Problem

The configuration described in the above document necessitates attaching an expensive sensor to an axis of each of the boom, the dipper stick and the bucket in order to determine the posture of a work implement, which is disadvantageous in terms of cost. Further, when a sensor is attached to the work implement, water, soil, and the like adhering to the work implement may affect the sensor in durability.

Herein is disclosed a hydraulic excavator and a system allowing a simple configuration to be employed to determine the posture of a work implement accurately.

Solution to Problem

According to the present disclosure, there is provided a hydraulic excavator including a revolving unit, a work implement, an imaging device, and a controller. The work implement and the imaging device are attached to the revolving unit. The work implement operates on a prescribed operating plane. The imaging device captures an image of the work implement at an angle larger than 0° with respect to the operating plane. The controller determines a position of the work implement relative to the revolving unit based on a posture of the work implement in the image captured by the imaging device.

Advantageous Effects of Invention

The present disclosure thus allows a simple configuration to be employed to determine the posture of a work implement accurately.

DESCRIPTION OF EMBODIMENTS

Hereinafter, an embodiment will be described with reference to the drawings. In the following description, identical components are identically denoted. Their names and functions are also identical. Accordingly, they will not be described repeatedly.

Figure 1:
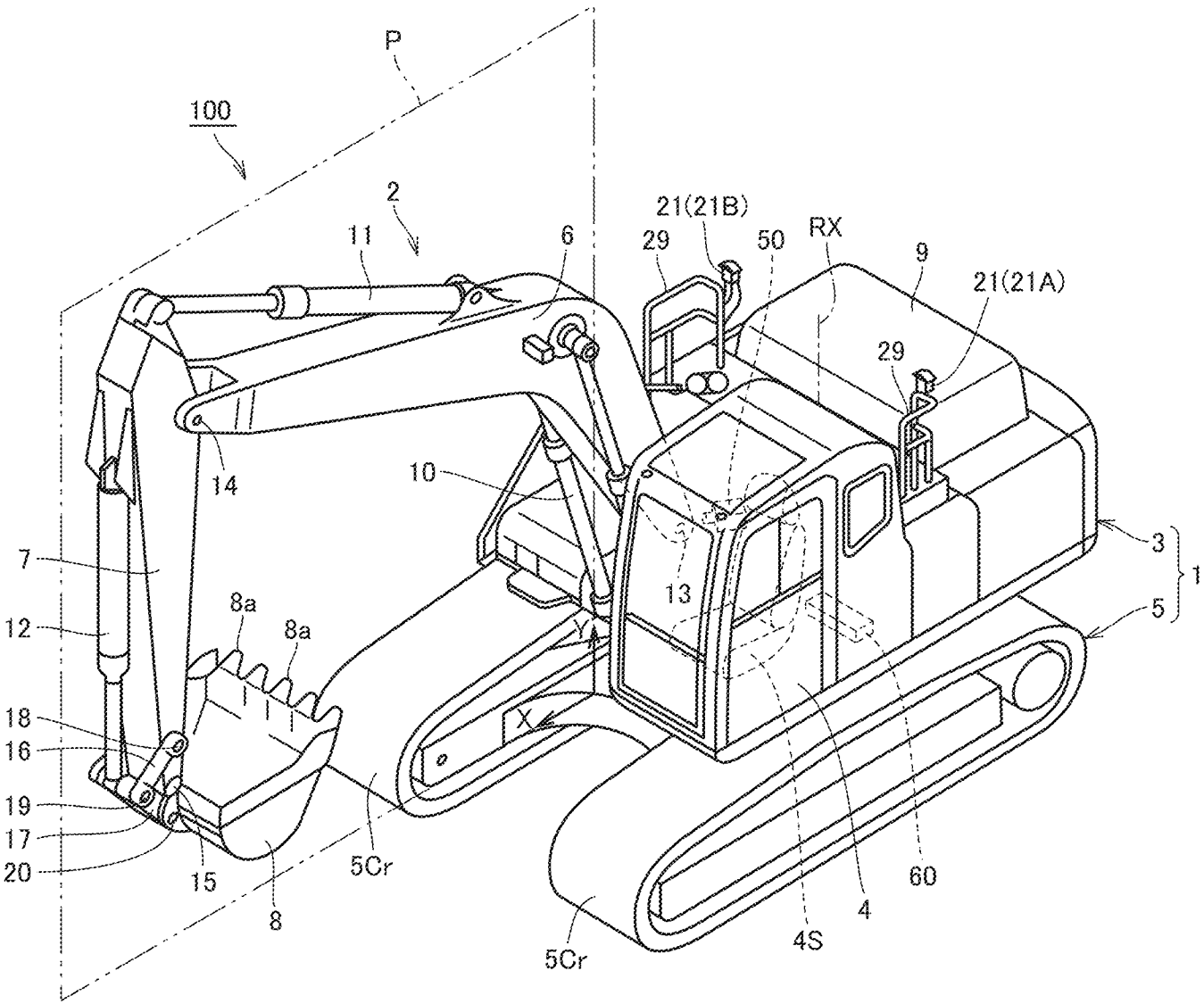
FIG. 1 is an appearance of a hydraulic excavator based on an embodiment.

FIG. 1 shows an appearance of a hydraulic excavator 100 based on an embodiment. As shown in FIG. 1, hydraulic excavator 100 has a main body 1 and a hydraulically operated work implement 2. Main body 1 has a revolving unit 3 and a traveling apparatus 5. Traveling apparatus 5 has a pair of crawler belts 5Cr. Hydraulic excavator 100 can travel as crawler belts 5Cr rotate. Traveling apparatus 5 may have wheels (tires).

Revolving unit 3 is disposed on traveling apparatus 5 and supported by traveling apparatus 5. Revolving unit 3 can revolve about an axis of revolution RX with respect to traveling apparatus 5. Revolving unit 3 has a cab 4. An occupant (or operator) of hydraulic excavator 100 gets in cab 4 and operates hydraulic excavator 100. Cab 4 is provided with an operator's seat 4S where the operator sits. The operator can operate hydraulic excavator 100 in cab 4. The operator in cab 4 can operate work implement 2, operate revolving unit 3 to revolve it with respect to traveling apparatus 5, and operate traveling apparatus 5 to cause hydraulic excavator 100 to travel.

Revolving unit 3 has an engine compartment 9 accommodating an engine and a counterweight provided in a rear portion of revolving unit 3. In engine compartment 9 are disposed an engine, a hydraulic pump and so forth (not shown).

Revolving unit 3 is provided with a handrail 29 frontwardly of engine compartment 9. Handrail 29 is provided with an antenna 21. Antenna 21 is for example an antenna for GNSS (Global Navigation Satellite Systems). Antenna 21 has a first antenna 21A and a second antenna 21B provided on revolving unit 3 and spaced from each other in a vehicular widthwise direction.

Work implement 2 is supported by revolving unit 3. Work implement 2 has a boom 6, a dipper stick 7, and a bucket 8. Boom 6 is pivotably coupled to revolving unit 3. Dipper stick 7 is pivotably coupled to boom 6. Bucket 8 is pivotably coupled to dipper stick 7. Bucket 8 has a plurality of teeth. Bucket 8 has a distal end portion, which will be referred to as a tooth tip 8*a*.

Boom 6 has a proximal end portion coupled to revolving unit 3 via a boom pin 13. Dipper stick 7 has a proximal end portion coupled to a distal end portion of boom 6 via a dipper stick pin 14. Bucket 8 is coupled to a distal end portion of dipper stick 7 via a bucket pin 15.

Hydraulic excavator 100 has a variety of components, and in the present embodiment, their positional relationship will be described with work implement 2 serving as a reference.

Boom 6 of work implement 2 pivots with respect to revolving unit 3 about boom pin 13 provided at the proximal end portion of boom 6. When a specific portion of boom 6 which pivots with respect to revolving unit 3, for example, a distal end portion of boom 6 moves, it provides a locus in an arc. A plane including the arc is specified as an operating plane P. When hydraulic excavator 100 is seen in a plan view, operating plane P is represented as a straight line. The straight line extends in a direction, which is a fore/aft direction of main body 1 of hydraulic excavator 100 or revolving unit 3, and it is hereinafter also simply referred to as the fore/aft direction. A lateral direction (or vehicular widthwise direction) of main body 1 of hydraulic excavator 100 or a lateral direction of revolving unit 3 is orthogonal to the fore/aft direction in a plan view, and it is hereinafter also simply referred to as the lateral direction.

A side where work implement 2 protrudes from main body 1 of hydraulic excavator 100 in the fore/aft direction is the fore direction and a direction opposite to the fore direction is the aft direction. A right side and a left side of the lateral direction when one faces front are the right direction and the left direction, respectively.

The fore/aft direction refers to a fore/aft direction of an operator who sits at the operator's seat in cab 4. A direction in which the operator sitting at the operator's seat faces is defined as the fore direction and a direction behind the operator who sits at the operator's seat is defined as the aft direction. The lateral direction refers to a lateral direction of the operator who sits at the operator's seat. A right side and a left side when the operator sitting at the operator's seat faces front are defined as the right direction and the left direction, respectively.

Boom 6 is pivotable about boom pin 13. Dipper stick 7 is pivotable about dipper stick pin 14. Bucket 8 is pivotable about bucket pin 15. Dipper stick 7 and bucket 8 are each a movable member movable on the side of the distal end of boom 6. Boom pin 13, dipper stick pin 14, and bucket pin 15 extend in a direction orthogonal to operating plane P, i.e., in the lateral direction. Operating plane P is orthogonal to at least one (in the embodiment, all three) of axes that serve as centers about which boom 6, dipper stick 7, and bucket 8 pivot.

As has been set forth above, boom 6 pivots on operating plane P with respect to revolving unit 3. Similarly, dipper stick 7 pivots on operating plane P with respect to boom 6, and bucket 8 pivots on operating plane P with respect to dipper stick 7. Work implement 2 of the embodiment has its entirety operated on operating plane P. Tooth tip 8*a* of bucket 8 moves on operating plane P. Operating plane P is a vertical plane including a range in which work implement 2 is movable. Operating plane P intersects each of boom 6, dipper stick 7, and bucket 8. Operating plane P can be set at a center of boom 6, dipper stick 7, and bucket 8 in the lateral direction.

As shown in FIG. 1, in the present specification, an X axis is set in a horizontal direction on operating plane P and a Y axis is set in a vertically upward direction on operating plane P. The X axis and the Y axis are orthogonal to each other.

Work implement 2 has a boom cylinder 10, a dipper stick cylinder 11, and a bucket cylinder 12. Boom cylinder 10 drives boom 6. Dipper stick cylinder 11 drives dipper stick 7. Bucket cylinder 12 drives bucket 8. Boom cylinder 10, dipper stick cylinder 11, and bucket cylinder 12 are each a hydraulic cylinder driven with hydraulic oil.

Bucket cylinder 12 is attached to dipper stick 7. As bucket cylinder 12 extends and contracts, bucket 8 pivots with respect to dipper stick 7. Work implement 2 has a bucket link. The bucket link couples bucket cylinder 12 and bucket 8 together. The bucket link has a first link member 16 and a second link member 17. First link member 16 and second link member 17 have their respective tips relatively rotatably coupled together via a bucket cylinder top pin 19. Bucket cylinder top pin 19 is coupled to a tip of bucket cylinder 12. Therefore, first link member 16 and second link member 17 are pinned to bucket cylinder 12.

First link member 16 has a proximal end rotatably coupled to dipper stick 7 via a first link pin 18 in a vicinity of bucket pin 15 located at the distal end portion of dipper stick 7. First link member 16 is pinned to dipper stick 7. Second link member 17 has a proximal end rotatably coupled via a second link pin 20 to a bracket located at a foot of bucket 8. Second link member 17 is pinned to bucket 8.

Hydraulic excavator 100 has an imaging device 50. Imaging device 50 in the embodiment is a monocular camera.

Imaging device 50 is attached to revolving unit 3. Imaging device 50 is attached to cab 4. Imaging device 50 is attached inside cab 4. Imaging device 50 is attached in a vicinity of an upper end of a left front pillar of cab 4. Imaging device 50 is disposed in an internal space of cab 4 in a vicinity of the left front pillar at a position away from work implement 2 in the lateral direction. Imaging device 50 is disposed apart from operating plane P of work implement 2 in the lateral direction. Imaging device 50 is disposed leftwardly of operating plane P.

A controller 60 is mounted on hydraulic excavator 100. Controller 60 will more specifically be described hereinafter.

In the embodiment, first link pin 18 and bucket cylinder top pin 19 are marked so that they are recognizable in an image captured by imaging device 50, and first link pin 18 is set as a feature point A and bucket cylinder top pin 19 is set as a feature point B. More specifically, a pin forming a feature point is entirely colored previously or colored so as to be outlined to highlight the feature point's geometrical line to provide the mark to thus allow the feature point to be recognizable in the captured image.

Figure 2:
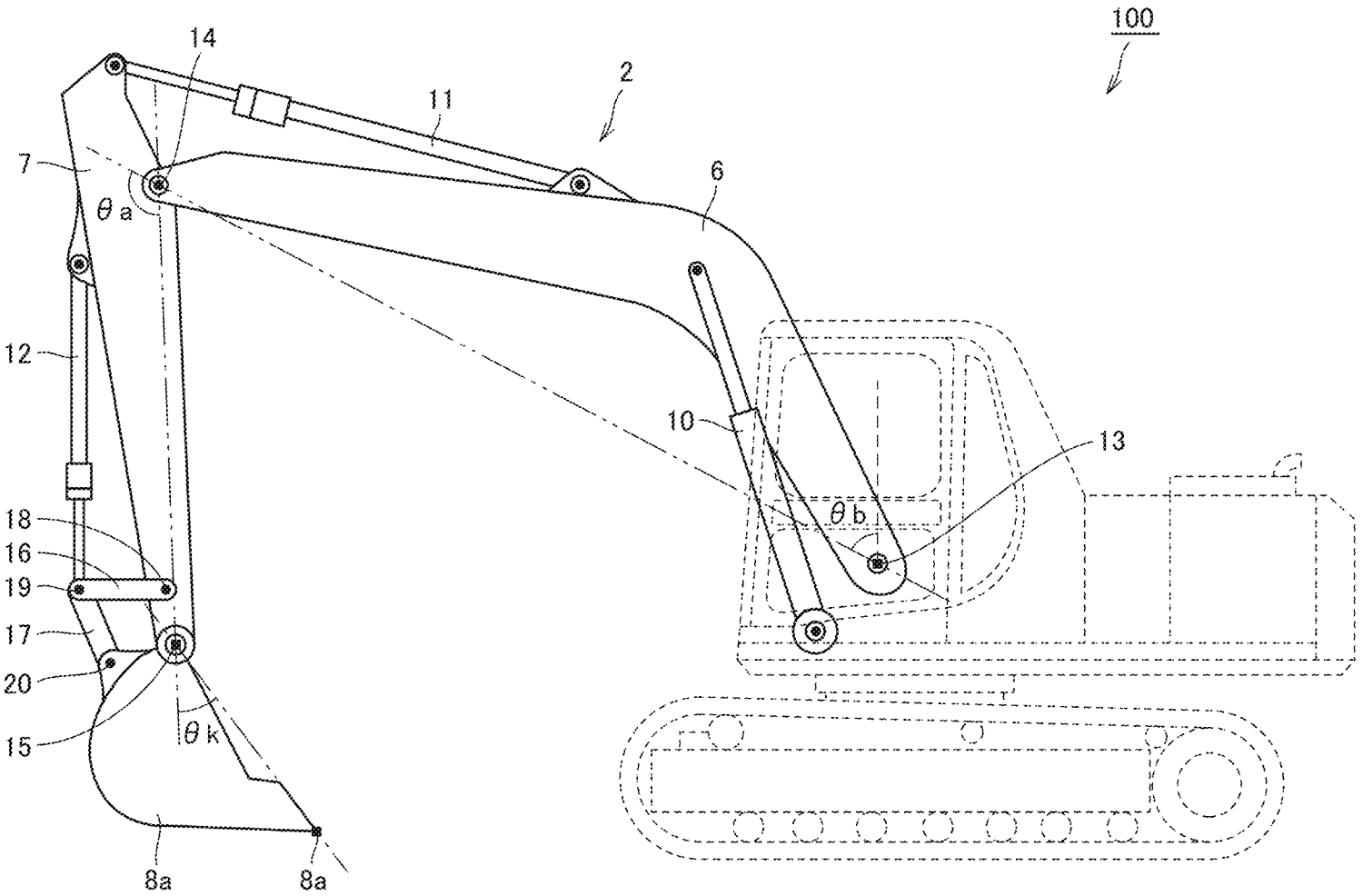
FIG. 2 is a side view of a work implement for illustrating a boom angle, a dipper stick angle, and a bucket angle.

FIG. 2 is a side view of work implement 2 for illustrating a boom angle θb, a dipper stick angle θa, and a bucket angle θk.

As shown in FIG. 2, an angle formed in a side view by a straight line passing through boom pin 13 and dipper stick pin 14 and a straight line extending in the vertical direction is defined as boom angle θb. Boom angle θb is an angle of boom 6 with respect to revolving unit 3.

An angle formed in a side view by a straight line passing through boom pin 13 and dipper stick pin 14 and a straight line passing through dipper stick pin 14 and bucket pin 15 is defined as dipper stick angle θa. Dipper stick angle θa is an angle of dipper stick 7 with respect to boom 6.

An angle formed in a side view by a straight line passing through dipper stick pin 14 and bucket pin 15 and a straight line passing through bucket pin 15 and tooth tip 8*a* is defined as bucket angle θk. Bucket angle θk is an angle of bucket 8 with respect to dipper stick 7.

A posture of work implement 2 on operating plane P is determined by a combination of boom angle θb, dipper stick angle θa, and bucket angle θk. For example, a position, or XY coordinates, on operating plane P of feature point A set on first link pin 18 located at the distal end portion of dipper stick 7 is determined by a combination of boom angle θb and dipper stick angle θa. A position, or XY coordinates, on operating plane P of feature point B set on bucket cylinder top pin 19 displacing as bucket 8 operates is determined by a combination of boom angle θb, dipper stick angle θa, and bucket angle θk.

Figure 3:
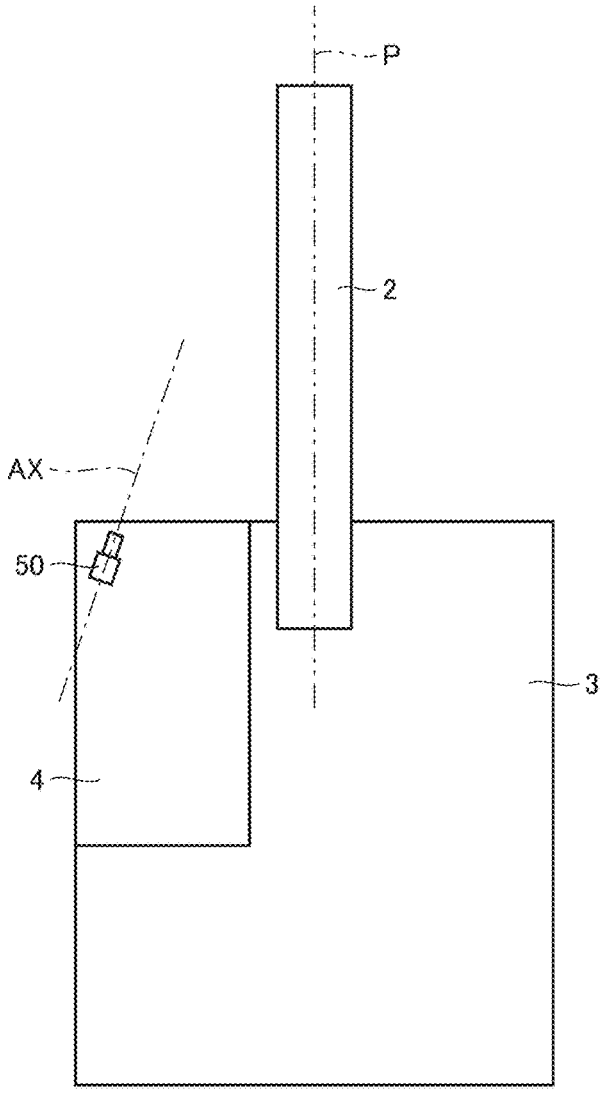
FIG. 3 is a schematic plan view of the hydraulic excavator shown in FIG. 1.

FIG. 3 is a schematic plan view of hydraulic excavator 100 shown in FIG. 1. FIG. 3 schematically illustrates work implement 2, revolving unit 3, cab 4, and imaging device 50 described with reference to FIG. 1. Operating plane P in FIG. 3 is represented as a straight line extending in the vertical direction in the figure, and is indicated by a chain double-dashed line. An optical axis AX indicated by a dot-dashed line in FIG. 3 is an optical axis of imaging device 50. Optical axis AX and operating plane P do not extend in parallel. Optical axis AX extends in a direction inclined with respect to that in which operating plane P extends.

Imaging device 50 is attached at a position at which the operating plane of work implement 2 is viewed in an oblique direction. Imaging device 50 captures an image of work implement 2 at an angle larger than 0° with respect to operating plane P. Work implement 2 and imaging device 50 are both attached to revolving unit 3, and even when hydraulic excavator 100 travels or revolves, imaging device 50 has a positional relationship unchanged with respect to operating plane P.

Imaging device 50 captures an image of work implement 2. Imaging device 50 images operating plane P of work implement 2. Imaging device 50 captures an image of work implement 2 moving on operating plane P. The image captured by imaging device 50 includes at least a portion of work implement 2.

Figure 4:
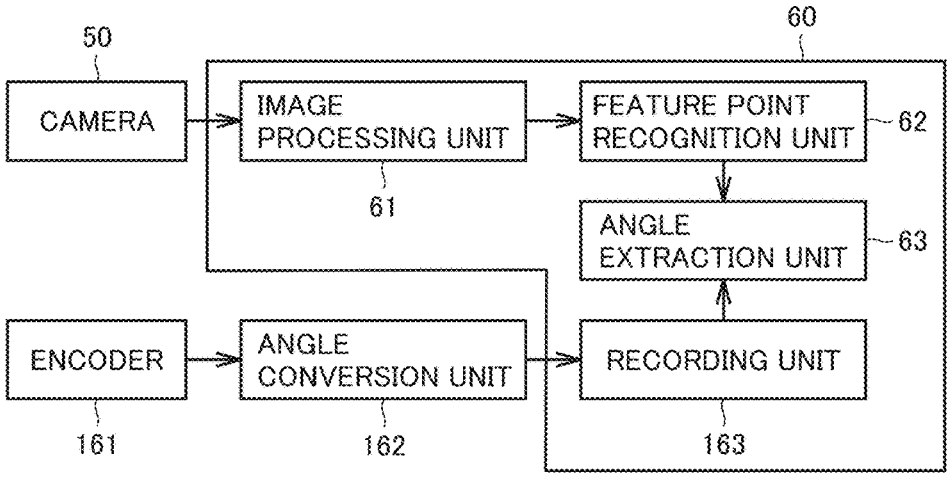
FIG. 4 is a block diagram showing a system configuration of the hydraulic excavator before shipment.

FIG. 4 is a block diagram showing a system configuration of hydraulic excavator 100 before shipment. Hydraulic excavator 100 includes controller 60. Controller 60 is configured to include a storage device such as a RAM (Random Access Memory) and a ROM (Read Only Memory) and a computing device such as a CPU (Central Processing Unit). Controller 60 has an image processing unit 61, a feature point recognition unit 62, an angle extraction unit 63, and a recording unit 163.

Image processing unit 61 receives from imaging device (camera) 50 an image captured by imaging device 50. Image processing unit 61 subjects the received, captured image to image processing. Image processing unit 61 sets an orthogonal coordinate system on the captured image. Image processing unit 61 sets a U axis extending in a horizontal direction of the captured image and a V axis extending in a vertical direction of the captured image. The U axis and the V axis are orthogonal to each other. Image processing unit 61 sets a UV coordinate system in the captured image.

Feature point recognition unit 62 recognizes in the captured image a feature point set on work implement 2. Feature point recognition unit 62 determines a position of feature point A (or first link pin 18) in the captured image and a position of feature point B (or bucket cylinder top pin 19) in the captured image. More specifically, feature point recognition unit 62 determines feature point A's UV coordinate components and feature point B's UV coordinate components. Feature point recognition unit 62 thus determines a posture of work implement 2 in the captured image.

Angle extraction unit 63 determines a position of work implement 2 relative to revolving unit 3 based on the posture of work implement 2 in the captured image. More specifically, angle extraction unit 63 determines boom angle θb, dipper stick angle θa, and bucket angle θk. As has been set forth above, imaging device 50 assumes a position constantly held fixed relative to operating plane P regardless of how hydraulic excavator 100 travels and how revolving unit 3 revolves. Therefore, once the UV coordinate components of feature points A and B in the captured image have been determined, the XY coordinate components of feature points A and B on operating plane P are uniquely determined. It can be said that XY coordinate components on operating plane P is a function of UV coordinate components in the captured image.

Hydraulic excavator 100 before shipment includes an encoder 161 and an angle conversion unit 162. Encoder 161 is a general term for a boom angle sensor attached to boom pin 13, a dipper stick angle sensor attached to the dipper stick pin, and a bucket angle sensor attached to the bucket link. Instead of encoder 161, a potentiometer may be attached to work implement 2 to measure an angle. A stroke sensor that senses the stroke of the hydraulic cylinder may be attached to convert an amount of movement of the hydraulic cylinder into an angle.

Angle conversion unit 162 receives an electrical signal from encoder 161 and converts the electrical signal into boom angle θb, dipper stick angle θa, and bucket angle θk.

Recording unit 163 associates a posture of the work implement reflected in the captured image, more specifically, the coordinates of first link pin 18 (or feature point A) and those of bucket cylinder top pin 19 (or feature point B) in the captured image, with boom angle θb, dipper stick angle θa and bucket angle θk obtained when the image is captured, and thus records the coordinates and the angles. The feature points and the angles are recorded in recording unit 163 at a factory before hydraulic excavator 100 is shipped.

Figure 5:
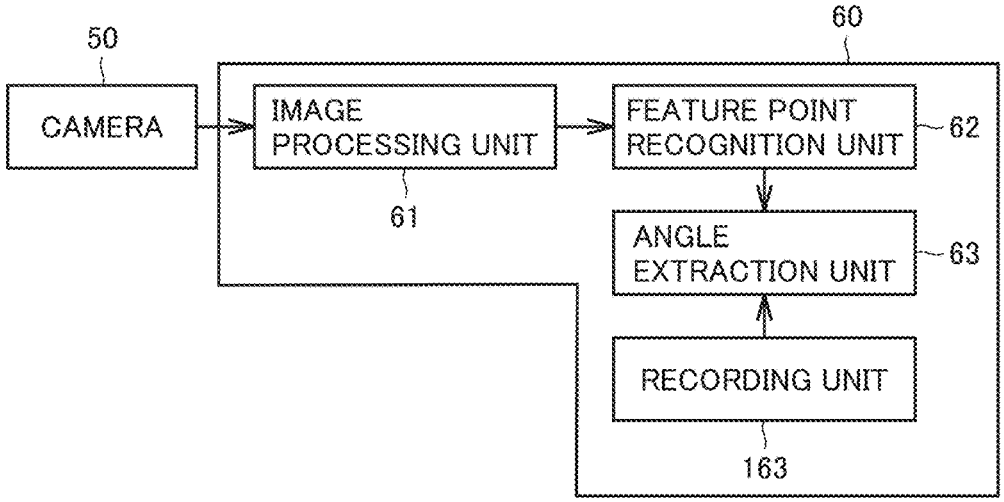
FIG. 5 is a block diagram showing a system configuration of the hydraulic excavator that is shipped from a factory.

FIG. 5 is a block diagram showing a system configuration of hydraulic excavator 100 when shipped from a factory. Encoder 161 is temporarily attached to work implement 2 for recording angles in recording unit 163 and removed from work implement 2 once the angles have been recorded in recording unit 163. Hydraulic excavator 100 shipped from the factory does not include encoder 161. Hydraulic excavator 100 shipped includes only imaging device 50 and controller 60 out of the system configuration shown in FIG. 4.

Figure 6:
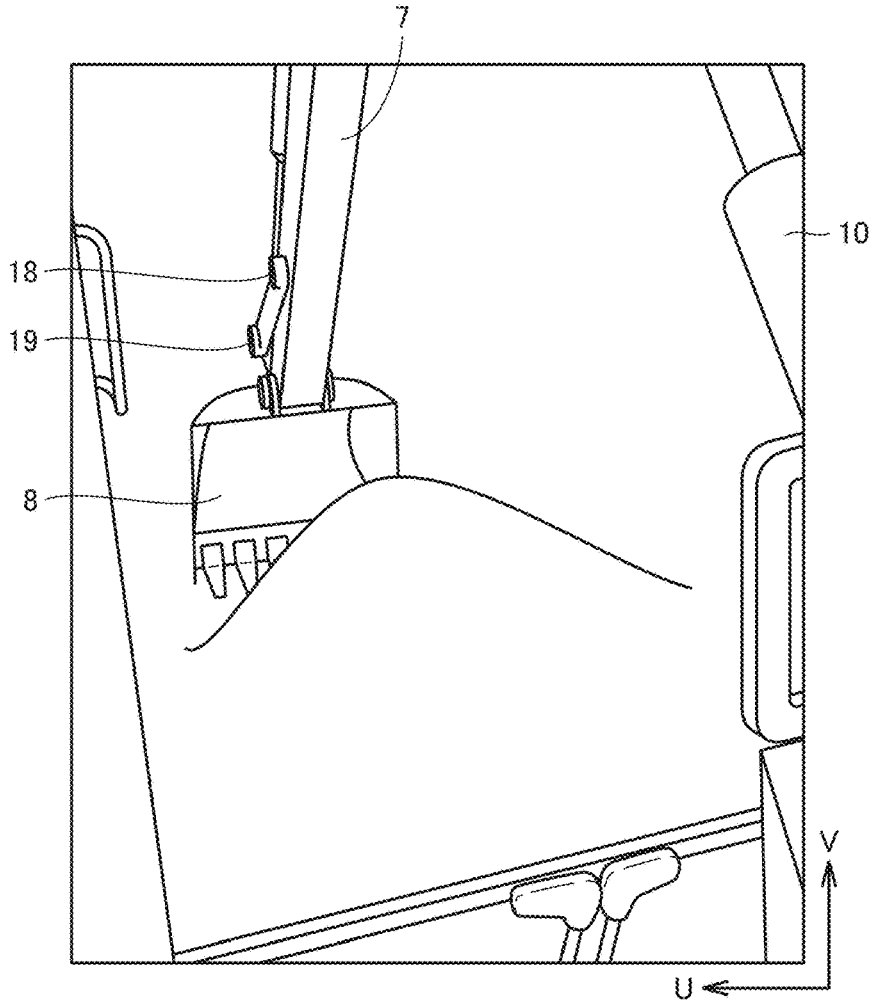
FIG. 6 is a schematic diagram showing an example of an image captured by an imaging device.

FIG. 6 is a schematic diagram showing an example of an image captured by imaging device 50. The captured image shown in FIG. 6 includes dipper stick 7 and bucket 8, and boom cylinder 10 of the components included in work implement 2, as well as a terrain in front of revolving unit 3. First link pin 18 and bucket cylinder top pin 19 are marked so that feature point A set on first link pin 18 and feature point B set on bucket cylinder top pin 19 are recognizable through image processing.

The captured image shown in FIG. 6 is vertically long. The U axis extends in the lateral direction of the captured image. The V axis extends in the vertical direction of the captured image. The origin of the UV coordinate system is set at a right corner of the captured image.

Hereinafter, based on a posture of work implement 2 in a captured image, that is, based on where feature points A and B are located in the captured image, a method for determining a position of the work implement relative to revolving unit 3, typically boom angle θb, dipper stick angle θa and bucket angle θk, will specifically be described.

Figure 7:
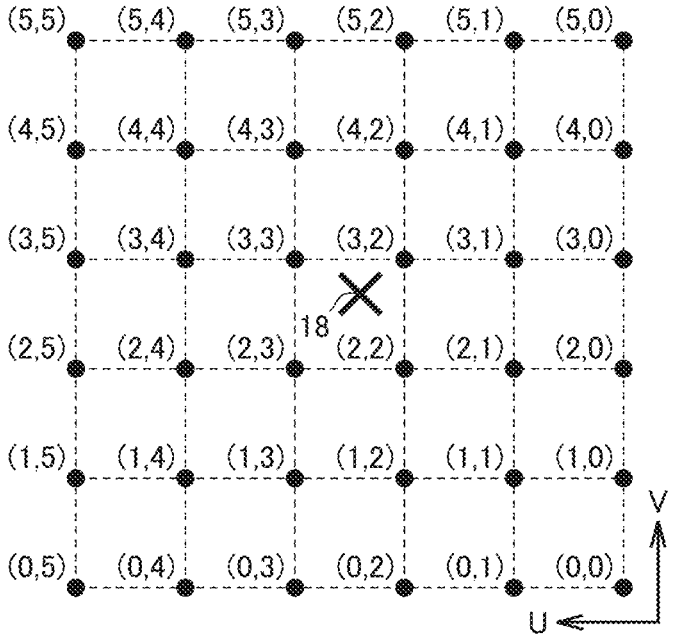
FIG. 7 is a schematic diagram showing recording points set in a captured image for a boom and a dipper stick.

FIG. 7 is a schematic diagram showing recording points set in a captured image for boom 6 and dipper stick 7. In FIG. 7, a total of 36 recording points having UV coordinate components of (0, 0) to (5, 5) are set. The recording points are aligned in six columns along the U axis and six rows along the V axis and thus set to be 6 times 6 for a total of 36 points.

Figure 8:
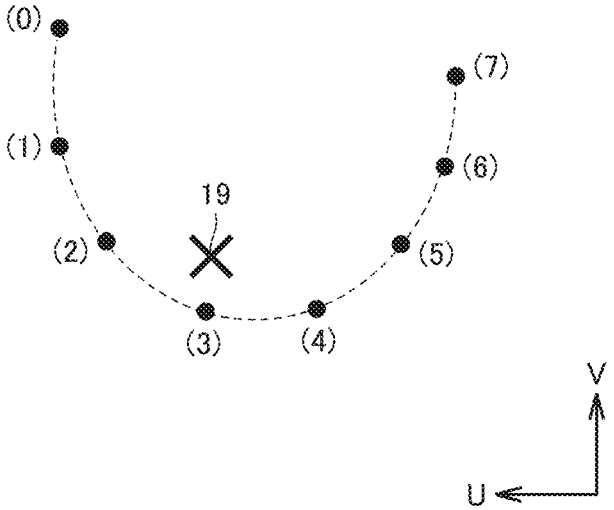
FIG. 8 is a schematic diagram showing recording points set in a captured image for a bucket.

FIG. 8 is a schematic diagram showing recording points set in a captured image for bucket 8. Bucket 8 moves relative to dipper stick 7 in a rotational movement about bucket pin 15 as an axis. Accordingly, as shown in FIG. 8, eight recording points (0) to (7) arranged on an arc are set.

Initially, encoder 161 shown in FIG. 4 is attached to work implement 2. For example, encoder 161 for measuring boom angle θb is attached to boom pin 13. For example, encoder 161 for measuring dipper stick angle θa is attached to dipper stick pin 14. For example, encoder 161 for measuring bucket angle θk is attached to a bucket link such as bucket cylinder top pin 19.

With encoder 161 attached to work implement 2, boom 6 and dipper stick 7 are operated to move the position of feature point A in the captured image to position the feature point at one of the recording points shown in FIG. 7. When feature point A is thus positioned, boom angle θb and dipper stick angle θa are stored in recording unit 163 (see FIG. 4). While feature point A is stopped, bucket 8 is operated to move the position of feature point B in the captured image to position the feature point at one of the recording points shown in FIG. 8. When feature point B is thus positioned, bucket angle θk is recorded in recording unit 163.

Once bucket angle θk has been recorded for all of the eight recording points shown in FIG. 8, boom 6 and dipper stick 7 are operated to position feature point A at a next one of the recording points shown in FIG. 7.

Work implement 2 is operated and the angles are recorded in this way for all of the recording points. After such recording is completed, encoder 161 is removed from work implement 2. A preparatory operation performed before hydraulic excavator 100 is shipped from a factory is thus completed.

When hydraulic excavator 100 is shipped from the factory, boom angle θb, dipper stick angle θa and bucket angle θk obtained when feature points A and B are located at each recording point in a captured image are stored in controller 60 (or recording unit 163).

After the shipment from the factory, when an image of work implement 2 is captured using imaging device 50 at a work site, feature point recognition unit 62 (see FIG. 4) recognizes a position of feature point A in the captured image. Angle extraction unit 63 determines a recording point of the 36 recording points shown in FIG. 7 that is the closest to the position of feature point A recognized. Referring to FIG. 7, when first link pin 18 set as feature point A is located at the position shown in FIG. 7, a recording point having UV coordinate components of (3, 2) is determined as the closest recording point.

Angle extraction unit 63 extracts boom angle θb and dipper stick angle θa corresponding to the closest recording point from recording unit 163, and sets them as the current boom angle θb and dipper stick angle θa.

Feature point recognition unit 62 also recognizes a position of feature point B in the captured image. Angle extraction unit 63 determines a recording point of the eight recording points shown in FIG. 8 that is the closest to the position of feature point B recognized. Referring to FIG. 8, when bucket cylinder top pin 19 set as feature point B is located at the position shown in FIG. 8, a recording point (3) is determined as the closest recording point.

Angle extraction unit 63 extracts bucket angle θk corresponding to the closest recording point from recording unit 163 and sets it as the current bucket angle θk.

Thus, boom angle θb, dipper stick angle θa, and bucket angle θk can be determined based on the positions of feature points A and B in the captured image. From boom angle θb, dipper stick angle θa and bucket angle θk thus determined, the XY coordinate components of feature points A and B on operating plane P can be determined, and a position of work implement 2 relative to revolving unit 3 can thus be determined.

A function and effect of the above embodiment will be described. In the embodiment, as shown in FIGS. 7 and 8, controller 60 determines a position of work implement 2 relative to revolving unit 3 based on a posture of work implement 2 in an image captured by imaging device 50. This can dispense with an angle sensor for sensing boom angle θb, dipper stick angle θa, and bucket angle θk. As the angle sensor is absent, its durability would never affect the operation of hydraulic excavator 100. This allows a simple, inexpensive and highly reliable configuration to be employed to determine the current posture of work implement 2, as done with hydraulic excavator 100 as conventional.

Further, as shown in FIG. 3, imaging device 50 has optical axis AX intersecting operating plane P of work implement 2. This allows imaging device 50 to capture an image of work implement 2 in a direction intersecting operating plane P, and a position of work implement 2 in the captured image can be uniquely associated with that of work implement 2 on operating plane P. Thus the captured image can be used to determine the current posture of work implement 2 accurately.

Further, as shown in FIG. 4, a relationship between information about a posture of work implement 2 in a captured image and boom angle θb, dipper stick angle θa and bucket angle θk is previously stored in controller 60, specifically at recording unit 163. Controller 60, specifically, angle extraction unit 63 determines boom angle θb, dipper stick angle θa and bucket angle θk based on the relationship between the information about the posture of work implement 2 in the captured image and boom angle θb, dipper stick angle θa and bucket angle θk.

Angle extraction unit 63 can use the information of the captured image and the angles of work implement 2 that are previously associated and thus stored to determine boom angle θb, dipper stick angle θa and bucket angle θk based on an image captured by imaging device 50. A simple configuration without an angle sensor can be employed to determine boom angle θb, dipper stick angle θa and bucket angle θk, as done in a conventional hydraulic excavator including an angle sensor.

Further, angle extraction unit 63 determines boom angle θb and dipper stick angle θa based on the posture of dipper stick 7 in the captured image, as shown in FIG. 7, and determines bucket angle θk based on the posture of bucket 8 in the captured image, as shown in FIG. 8. A posture of dipper stick 7 is determined by a combination of boom angle θb and dipper stick angle θa, and a posture of bucket 8 is determined by a combination of boom angle θb, dipper stick angle θa and bucket angle θk. Boom angle θb and dipper stick angle θa can first be determined based on the posture of the dipper stick, and then bucket angle θk can be determined based on the determined boom angle θb and dipper stick angle θa and the posture of bucket 8.

Further, as shown in FIG. 6, feature point A is set on first link pin 18 provided at dipper stick 7. Feature point B is set on bucket cylinder top pin 19 provided at the bucket link. Controller 60, specifically, feature point recognition unit 62, determines a posture of dipper stick 7 by determining a position of feature point A in a captured image, and determines a posture of bucket 8 by determining a position of feature point B in the captured image. Thus setting feature points A and B recognizable in a captured image facilitates determining a posture of dipper stick 7 and bucket 8 in the captured image.

Further, as shown in FIGS. 1 and 3, imaging device 50 is attached to cab 4. Typically, hydraulic excavator 100 has the proximal end portion of boom 6 and cab 4 aligned in the lateral direction. Imaging device 50 attached to cab 4 can reliably capture an image of work implement 2 in a direction intersecting operating plane P. Disposing imaging device 50 in a vicinity of a left side of cab 4 to increase a distance between imaging device 50 and work implement 2 can increase an angle of optical axis AX of imaging device 50 inclined with respect to operating plane P of work implement 2 to determine the current posture of work implement 2 further accurately.

Further, as shown in FIG. 1, imaging device 50 is attached inside cab 4. Imaging device 50 can thus be protected from dirt, dust, wind and rain, and thus enhanced in durability. Further, for the specifications of imaging device 50, the necessity of dustproofing and waterproofing can be reduced, and imaging device 50 can be more inexpensive.

Further, as shown in FIG. 3, imaging device 50 is a monocular camera. Imaging device 50 that is an inexpensive monocular camera allows a simpler configuration to be employed to determine the current posture of work implement 2.

In the above embodiment an example has been described in which angles of a work implement stored in association with recording points that are closest to the positions of feature points A and B in a captured image are set as the work implement's current angles. As shown in FIGS. 7 and 8, when a feature point in a captured image assumes a position deviating from a recording point, the angles of the work implement associated with two adjacent recording points close to the feature point may be interpolated to determine the work implement's current angle, and the work implement's current angle can thus be determined further accurately.

A plurality of sets of data in which the positions of feature points A and B in a captured image are associated with a posture of work implement 2 may be recorded in recording unit 163 described above. For example, a position of bucket 8 in grading a horizontal land surface and that of bucket 8 when shaping a vicinity of a shoulder of a slope from a foot of the slope are significantly different and it is difficult to accommodate them within the same single angle of view of imaging device 50. Accordingly, when data obtained when imaging device 50 images a front side and data obtained when imaging device 50 images an obliquely upper side are previously recorded, and imaging device 50 can be angularly adjusted and appropriate data can be selected depending on the contents of the work of interest, the current posture of work implement 2 operating in a wide range can be determined accurately.

While feature point A described above is set on first link pin 18 located at the distal end portion of dipper stick 7, feature point A may instead be set on boom 6. In that case, boom angle θb can be determined from a position of feature point A in a captured image, and dipper stick angle θa and bucket angle θk can be determined based on the determined boom angle θb and a posture of bucket 8 to determine all of boom angle θb, dipper stick angle θa and bucket angle θk, similarly as done in the embodiment.

In the description of the above embodiment, hydraulic excavator 100 includes controller 60 and controller 60 mounted on hydraulic excavator 100 determines a relative position of work implement 2 by way of example. The controller that determines the relative position of work implement 2 may not be mounted on hydraulic excavator 100.

Figure 9:
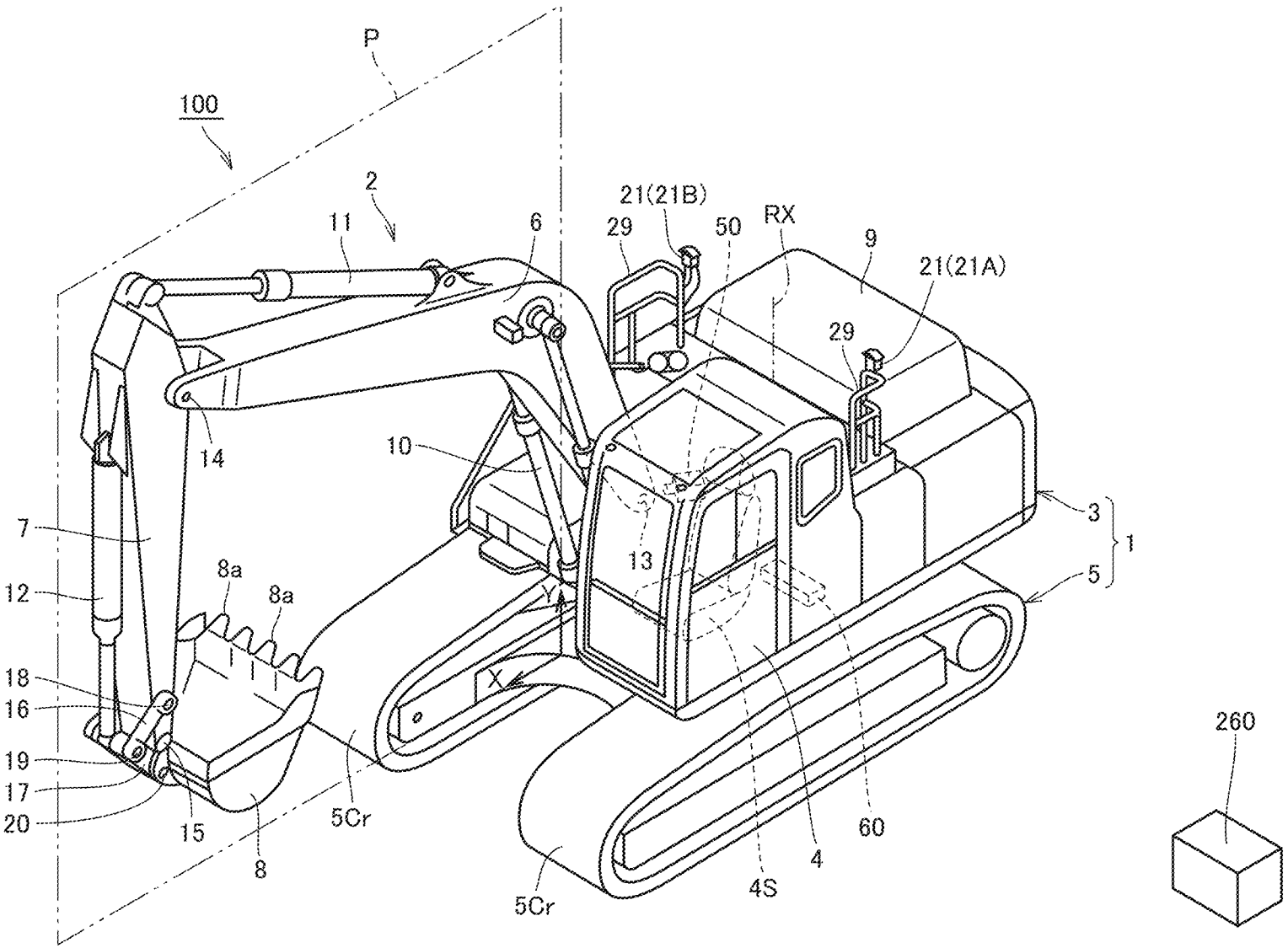
FIG. 9 is a schematic diagram of a system including a hydraulic excavator.

FIG. 9 is a schematic diagram of a system including hydraulic excavator 100. There may be configured a system in which controller 60 of hydraulic excavator 100 receives a captured image from imaging device 50 and sends the received captured image to an external controller 260, which receives the sent captured image and determines a relative position of work implement 2. Controller 260 may be disposed at a work site of hydraulic excavator 100, or may be disposed in a place remote from the work site of hydraulic excavator 100.

The presently disclosed embodiments are to be considered as illustrative in any respect and not restrictive. The scope of the present invention is not indicated by the above description but by the scope of the claims, and is intended to include meaning equivalent to the terms of the claims and any modifications within the scope.

REFERENCE SIGNS LIST

1 main body, 2 work implement, 3 revolving unit, 4 cab, 5 traveling apparatus, 6 boom, 7 dipper stick, 8 bucket, **8*a* tooth tip, 10 boom cylinder, 11 dipper stick cylinder, 12 bucket cylinder, 13 boom pin, 14 dipper stick pin, 15 bucket pin, 16 first link member, 17 second link member, 18 first link pin, 19 bucket cylinder top pin, 20 second link pin, 50 imaging device, 60, 260 controller, 61 image processing unit, 62 feature point recognition unit, 63 angle extraction unit, 100 hydraulic excavator, 161 encoder, 162 angle conversion unit, 163** recording unit, A and B feature points, AX optical axis, P operating plane, RX axis of revolution.

The invention claimed is:

1. A hydraulic excavator comprising:

a revolving unit;

a work implement that is attached to the revolving unit and operates on a prescribed operating plane, the work implement has a boom coupled with the revolving unit and a dipper stick coupled with the boom;

an imaging device that is attached to the revolving unit and captures an image of the work implement at an angle larger than 0° with respect to the operating plane; and a controller that determines a position of the work implement relative to the revolving unit based on a posture of the work implement in the image captured by the imaging device, wherein a relationship between information about the posture of the work implement in the captured image and an angle of the boom with respect to the revolving unit and an angle of the dipper stick with respect to the boom is previously stored in the controller, and the controller determines an angle of the boom and an angle of the dipper stick based on the relationship.

2. The hydraulic excavator according to claim 1, wherein the work implement further has a bucket coupled with the dipper stick, a relationship between information about the posture of the work implement in the captured image and the angle of the boom with respect to the revolving unit, the angle of the dipper stick with respect to the boom, and an angle of the bucket with respect to the dipper stick is previously stored in the controller, and the controller determines an angle of the bucket based on the relationship.

3. The hydraulic excavator according to claim 2, wherein the controller determines the angle of the boom and the angle of the dipper stick based on a posture of the dipper stick in the captured image.

4. The hydraulic excavator according to claim 3, wherein a feature point is set on the dipper stick, and the controller determines the posture of the dipper stick by determining a position of the feature point in the captured image.

5. The hydraulic excavator according to claim 2, wherein the controller determines the angle of the bucket based on a posture of the bucket in the captured image.

6. The hydraulic excavator according to claim 5, wherein the work implement further includes a bucket cylinder attached to the dipper stick and extending and contracting to cause the bucket to pivot with respect to the dipper stick, and a bucket link coupling the bucket cylinder and the bucket together, a feature point is set on the bucket link, and the controller determines the posture of the bucket by determining a position of the feature point in the captured image.

7. The hydraulic excavator according to claim 1, wherein the imaging device has an optical axis intersecting the operating plane.

8. The hydraulic excavator according to claim 1, further comprising a cab which an occupant gets in, wherein the imaging device is attached to the cab.

9. The hydraulic excavator according to claim 8, wherein the imaging device is attached inside the cab.

10. The hydraulic excavator according to claim 1, wherein the imaging device is a monocular camera.

11. A system comprising:

a work implement that operates on a prescribed operating plane, the work implement has a boom coupled with the revolving unit and a dipper stick coupled with the boom;

an imaging device that captures an image of the work implement at an angle larger than 0° with respect to the operating plane; and a controller that determines a position of the work implement relative to the imaging device based on a posture of the work implement in the image captured by the imaging device, wherein a relationship between information about the posture of the work implement in the captured image and an angle of the boom with respect to the revolving unit and an angle of the dipper stick with respect to the boom is previously stored in the controller, and the controller determines an angle of the boom and an angle of the dipper stick based on the relationship.

* * * * *